US005669402A

United States Patent [19]

Sun

[11] Patent Number: 5,669,402

[45] Date of Patent: Sep. 23, 1997

[54] WATER COLLECTION DEVICE DERIVED FROM AN UMBRELLA

[76] Inventor: San-Shiung Sun, 3F, No.31, 141 Alley, 189 Lane, Kang-Ning Rd. Sec 3, Nei-Hu District, Taipei City, Taiwan

[21] Appl. No.: 669,125

[22] Filed: Jun. 24, 1996

Related U.S. Application Data

[63] Continuation of Ser. No. 521,417, Aug. 30, 1995, abandoned.

[51] Int. Cl.[6] ..... A45B 25/18

[52] U.S. Cl. ..... 135/33.2; 135/48

[58] Field of Search ..... 135/16, 33.2, 33.41, 135/33.7, 33.71, 48

[56] References Cited

U.S. PATENT DOCUMENTS

| | | | |
|---|---|---|---|
| 76,129 | 3/1868 | Winter et al. | 135/48 |
| 488,407 | 12/1892 | Thomas | 135/48 |
| 927,914 | 7/1909 | Winkelman | 135/48 |
| 980,849 | 1/1911 | Sutlive | 135/48 |
| 1,031,974 | 7/1912 | Thomas | 135/33.7 |
| 2,334,596 | 11/1943 | Bardy | 135/48 |
| 3,456,661 | 7/1969 | Farley | 135/33.7 |
| 4,203,457 | 5/1980 | Friedman et al. | 135/33.7 X |
| 4,865,063 | 9/1989 | Williams | 135/33.7 |
| 5,178,175 | 1/1993 | Lin | 135/48 |
| 5,313,970 | 5/1994 | Hung | 135/48 X |

FOREIGN PATENT DOCUMENTS

| | | | |
|---|---|---|---|
| 1551528 | 8/1979 | United Kingdom | 135/33.7 |

*Primary Examiner*—Lanna Mai

[57] ABSTRACT

A water collection device derived from an umbrella comprises an umbrella having a first canopy and a less diameter second canopy covering the top of the first canopy and circumferentially connected spaced apart with the first canopy so as to define a plurality of continuous openings therearound for collecting the water drops from the first canopy when the umbrella is closed and leaned upside down inside a house or a car. A third canopy of more less diameter covers on the top of the second canopy and circumferentially connects spaced apart with the second canopy to define a plurality of additional continuous openings therearound for receiving the water drops from the second canopy. A water conduit and releasing system formed in the upper portion of a tubular shank and communicated with the openings can receive a large amount of water from the openings.

3 Claims, 4 Drawing Sheets

FIG. 4
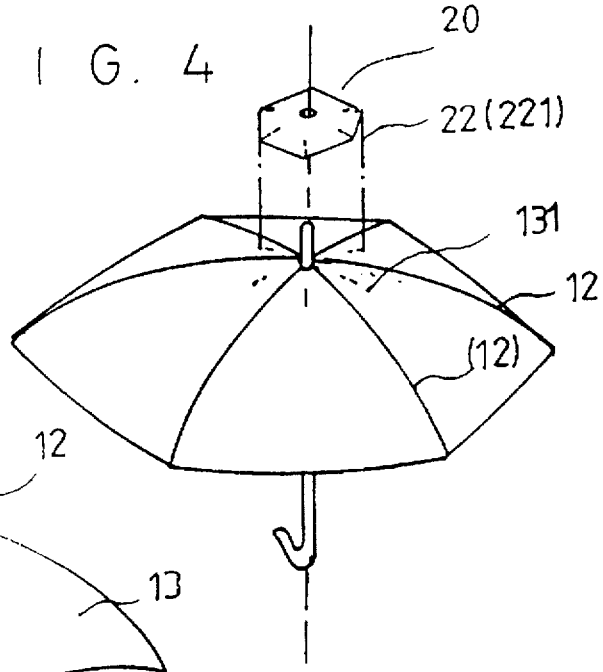
FIG. 2
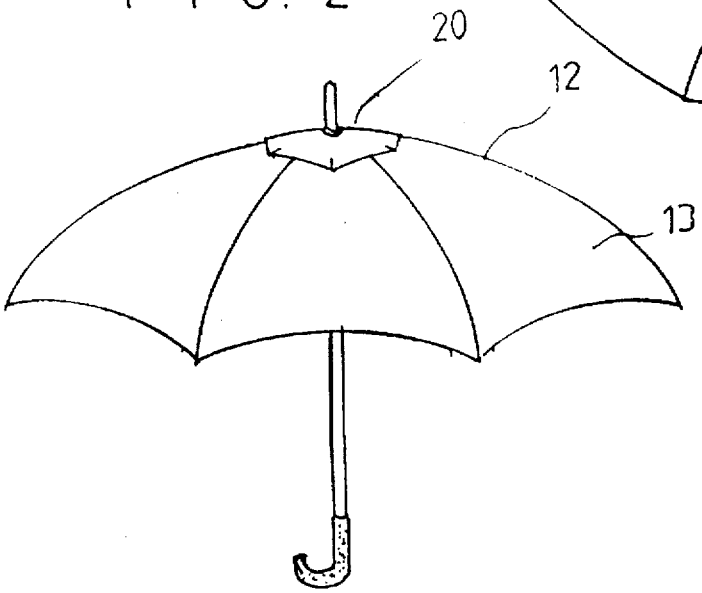
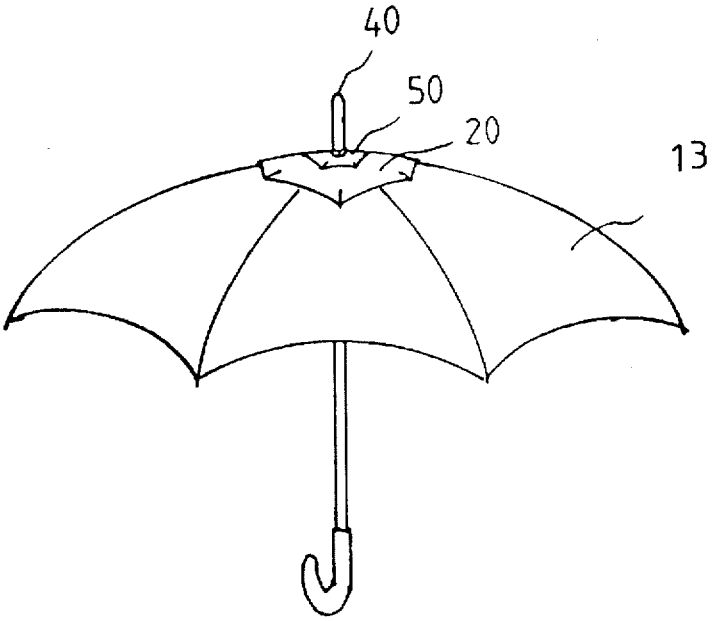
FIG. 3

FIG. 5
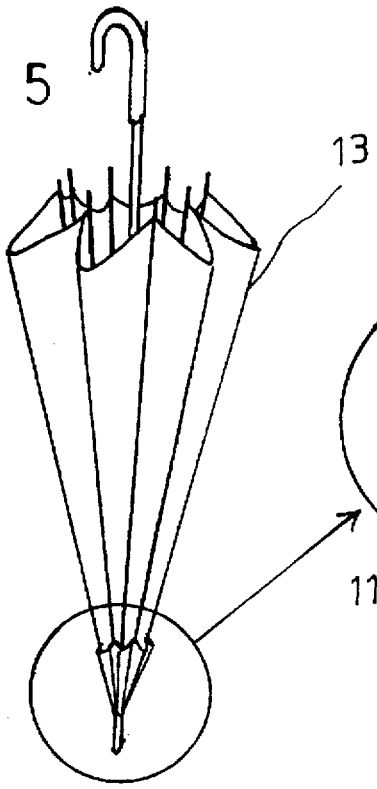
FIG. 5A
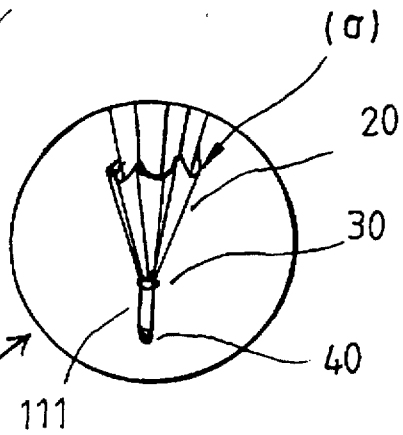
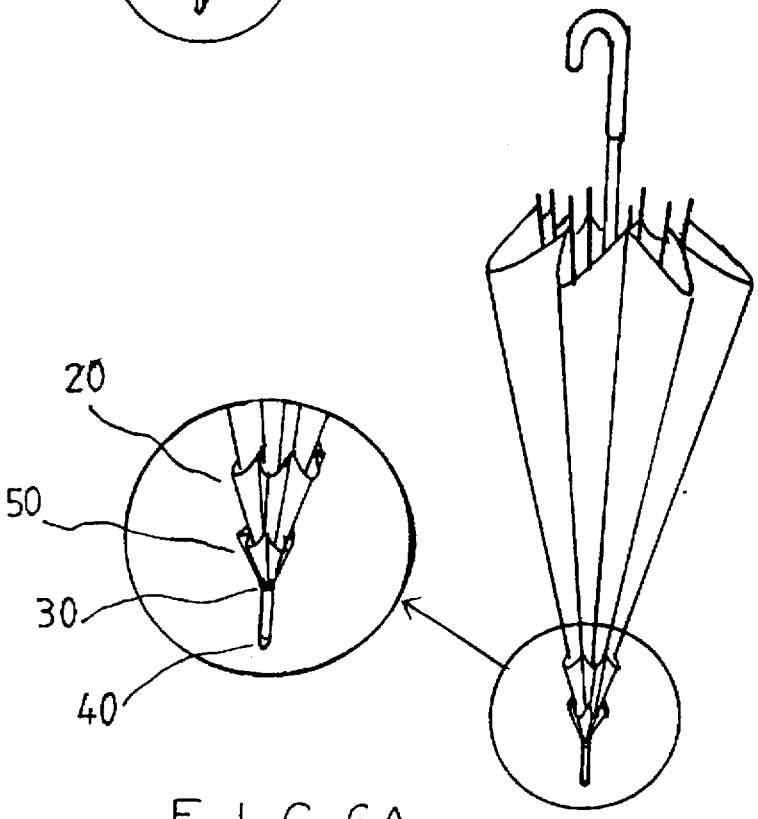
FIG. 6A
FIG. 6

FIG. 7
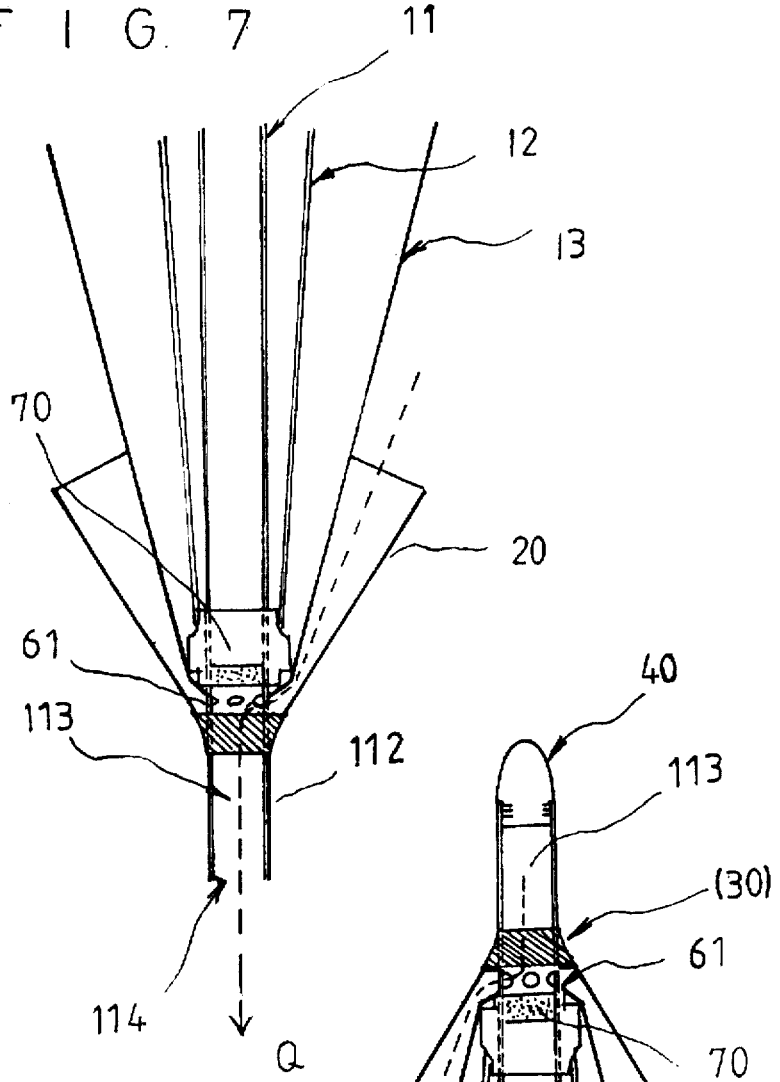
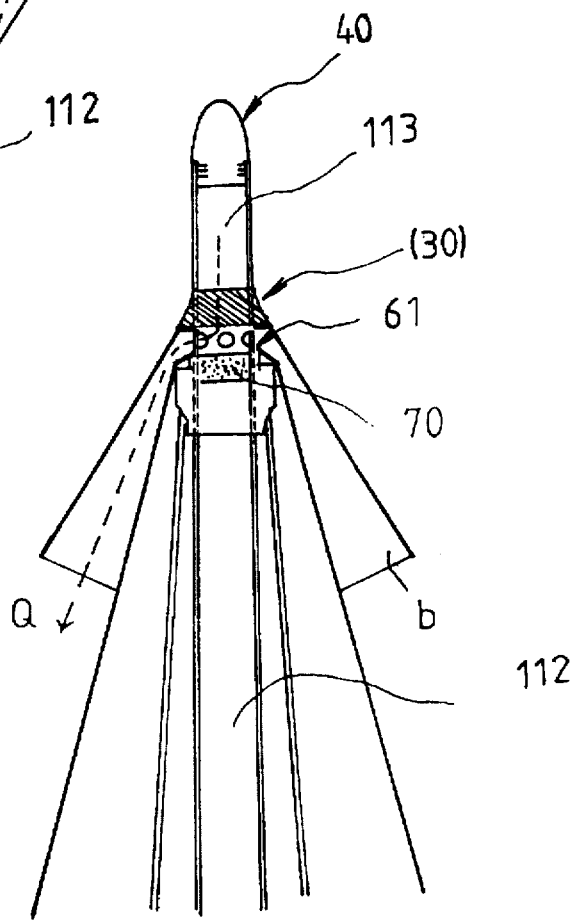
FIG. 8

WATER COLLECTION DEVICE DERIVED FROM AN UMBRELLA

This is a continuation application of an U.S. application Ser. No. 08/521,417, filed Aug. 30, 1995, now is abandoned.

BACKGROUND OF THE INVENTION

The present invention relates to umbrellas and more particularly to a water collection device directly derived from the canopy of an umbrella which is a less diameter second (or second and third) canopy circumferentially connected spaced apart to the surface of the first canopy of an umbrella. The intervals between every connection spots are average and each of the connection spots is positioned at the middle of a latitudinal line between every pair of adjacent ribs. So that the collapsing of the ribs will effect an outward movement of the connection spots that automatically forms a plurality of continuous openings therearound to receive the residual water drops from the first canopy of the umbrella. In the bottom of the openings, there is a water passage formed to communicated with the hollow interior of the tubular shank which is blocked up by a stopper means at an appropriate position beneath the passages and a releasible finishing cap covers the top of the shank, so that water can be collected in the upper portion of the shaft and released by removal of the finishing cap.

Normally, an umbrella of prior art, having been used in the rain, contains a certain amount of residual water on its canopy. When the umbrella is collapsed inside a house or a car, the residual water thereon will drip down and splash over the floor. This causes a great unpleasant in daily life. To solve such cumbersome problem, a series of water collection devices for umbrella have been disclosed. However, these water collection devices similarly have their independent structure and complete components attached to the top of an umbrella and operated in concert with the umbrella. None of them utilize the original structure to naturally derive a water collection device from an umbrella. Therefore, increasing the weight to carry an umbrella or cost to manufacture an umbrella, especially, altering the original appearance of the umbrella.

SUMMARY OF THE PRESENT INVENTION

The main object of the present invention is to provide a water collection device which is automatically derived from the original canopy of an umbrella when the umbrella is closing in order to timely and effectively collect the water drops from the surface of the umbrella. The derived water collection device will be concealed and invisible when the umbrella is opening in order to maintain the natually beautiful appearance of an opening umbrella.

Another object of the present invention is to provide a water collection and releasing system for umbrella which has an additional receiving space provided in the tubular shank of the umbrella communicating with the water collection device in order to collect more residual water from the umbrella.

Still another object of the present invention is to provide a water collection device for umbrella which avoids additional complicated components.

Further object of the present invention is to provide a water collection device for umbrella which will not be burdensome to the original umbrella.

Accordingly, the water collection device of the present invention utilizes the collapsing of the ribs of an umbrella to effect the first and the less diameter second or third canopies thereon to sequentially collapse and to automatically derive a plurality of continuous openings from the umbrella which will be timely collect the residual water drops from the umbrella. An additional receiving space in a releasing system is provided in the upper portion of a tubular shank of the umbrella and communicates to the water collection device which receives the water from the collection device and releases it at later stage.

The present invention will become more fully understood by reference to the following detailed description thereof when read in conjunction with the attached drawings.

BRIEF DESCRIPTION OF THE DRAWINGS

FIG. 2 is a perspective view to show a less diameter second canopy attached to the first canopy when the umbrella is opening, FIG. 3 is a perspective view to show a second and a third less diameter canopy sequentially attached to the first canopy when the umbrella is opening, FIG. 4 is an exploded perspective view illustrating the connection spots arranged between the first canopy and the second canopy, FIGS. 5 and 5A are the perspective views to show the water collection device of the second canopy derived from the first canopy of the umbrella, FIGS. 6 and 6A are the perspective views to show the collection deivce of both the second canopy and the third canopy derived from the first canopy of the umbrella, FIG. 7 is a perspective view to show a water conduit and releasing system of the present invention, and FIG. 8 is a perspective view to show a water driving process of FIG. 7.

DETAILED DESCRIPTION OF THE PREFERRED EMBODIMENT

Figure 1:
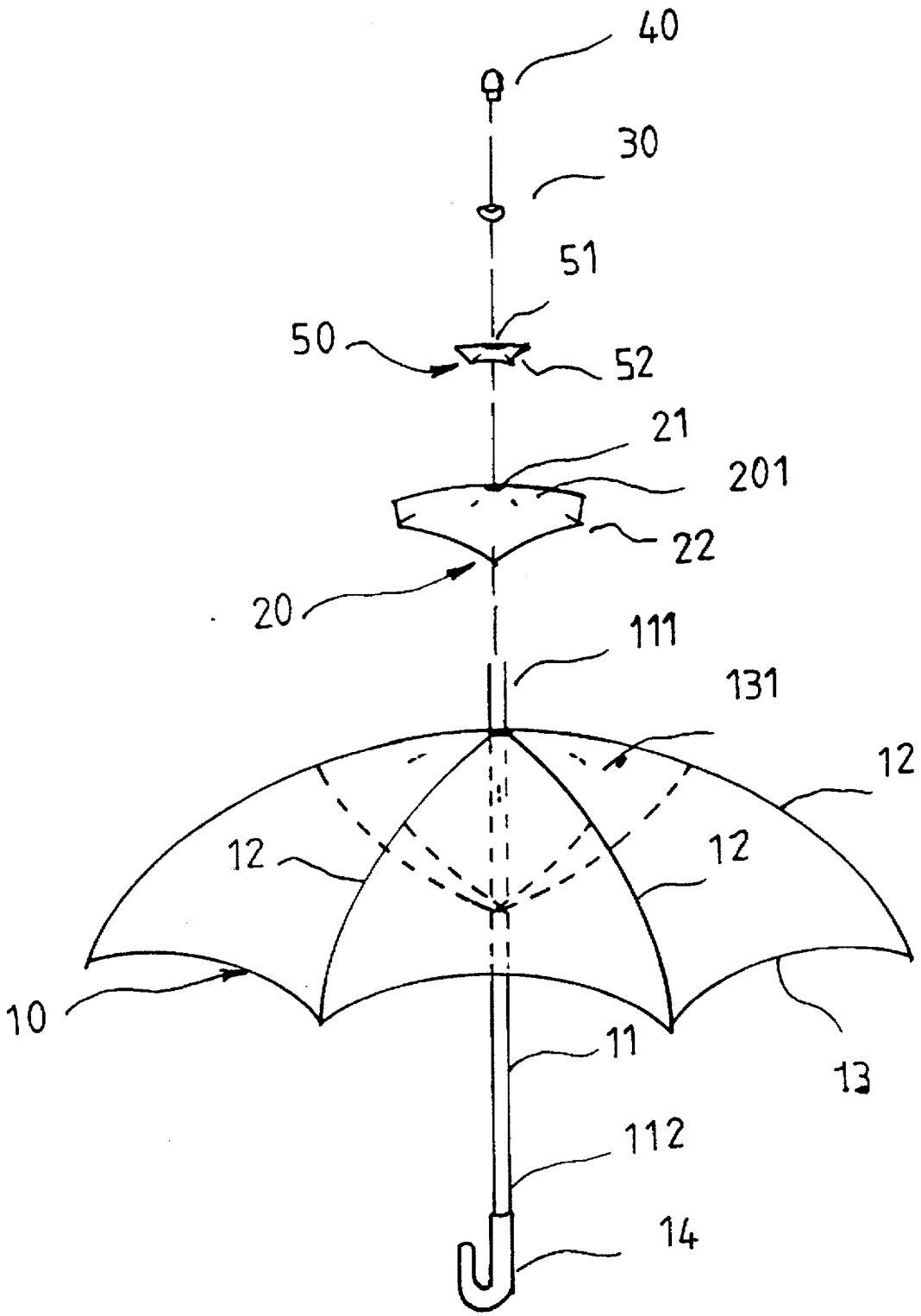
FIG. 1 is an exploded perspective view to show a preferred embodiment of the present invention.

Referring to FIGS. 1 and 4, the water collection device of the present invention is composed of a less diameter second canopy 20 and/or a third canopy 50 attached to a first canopy 13 of an umbrella 10. The umbrella 10 comprises at least a tubular shank 11 and a plurality of ribs 12 to construct a framework of the umbrella 10, a first canopy 13 axially attached to the framework and secured sequentially by a finishing cap 40 and a ferrule 30 on the top thereof, a handle 14 and the operational mechanism secured on the lower end of the shank 11. The less diameter second canopy 20 has a central hole 21 co-axially wrapped and closed on the upper portion 111 of the shank 11 and is positioned between the ferrule 30 and the first canopy 13 and is then circumferentially attached to the surface of the first canopy 13 by a plurality of first connection spots 22 which are spacedly arranged along the circumference in their equal distances and at their positions at the middle 131 of a latitudinal line between each pair of adjacent ribs 12. A lesser diameter third canopy 50 has a central hole 51 co-axially wrapped and closed on the upper portion 111 of the shank 11 between the ferrule 30 and the second canopy 20 and is circumferentially attached to the surface of the second canopy 20 by a plurality of spaced second connection spots 52 of equal interval which are positioned at the middle 201 of a latitudinal line between each pair of the adjacent first connection spots 22. Then the central holes 21 and 51 are closed by the ferrule 30 on the top of the shank 11 (as shown in FIGS. 2 and 3).

Therefore a plurality of continuous receiving space large and small are formed by the second and third canopies 20 and 50 and operated in concert with the collapsing of the ribs 12 (as shown in FIGS. 5, 5A, 6 and 6A).

Referring to FIGS. 7 and 8, a water conduit and releasing system 60 is shown which comprises a plurality of water passages 61 spacedly formed around a peripheral wall of the tubular shank 11 therethrough and communicating the bottom of the water receiving space and the hollow interior 113 of the shank 11, a stopper means 70 for blocking up the hollow interior 112 stopped at an appropriate position beneath the passages 61 and a removable the finishing cap 40 covered the top of the shank 11. So that the residual water collected in the receiving space can be diverted via the passages 61 into the hollow interior 113 of the shank 11 and released by removal of the finishing cap 40.

The application of the water collection device of the present invention can be specified in the following examples:

1) Under condition of that the less diameter second and third canopies 20 and 50 and the water conduit and releasing system Q are applicable simultaneously and because of that the second and third canopies 20 and 50 are co-axially wrapped on the upper portion 111 of the shank 11 and circumferentially attached to the first canopy 13 and the interval of the connection spots are averagedly arranged (as shown in FIGS. 2 and 3). When the umbrella 10 opens in the rain, the canopies are conformably attached together and the rain drops will drip down natually along the arcuate surface of the umbrella. This time, the appearance and function of the present invention is similar to a conventional umbrella and a small piece of canopy and the stopper added to an umbrella will bear no any burden to the umbrella, nor damage the natural nicety of the umbrella.

2) When the umbrella of the present invention is closed after applied in the rain (as shown in FIGS. 1 and 4), because the connection spots 22 between the less diameter second canopy 20 and the first canopy 13 are of equal distances and on the first canopy 13 where the circumference of the second canopy 20 covers and because the connection spots are positioned at the middle 131 of a latitudinal line between each pair of the adjacent ribs 12, the collapsing of the ribs 12 will effect the connection spots 22 and 52 to simultaneously fold outward. So that the less diameter second canopy 20 along with the outward folding movement of the first canopy 13 will fold outward also to form a plurality of continuous first openings therearound (as shown in FIGS. 5 and 5A) and the lesser diameter third canopy 50 along with the outward folding movement will fold outwardly too to form a plurality of smaller continuous second openings therearound (as shown in FIGS. 6 and 6A). Besides the central holes 21 and 51 of the second and third canopies 20 and 50 are closed by the ferrule 30 in the upper portion 111 of the shank 11, a receiving space is therefore derived from the first canopy 13 along with the closing of the umbrella.

Thus, when the umbrella is put there up side down, the residual water drops remained on the surface of the first canopy 13 of the umbrella 10 will drip into the receiving space derived from between the first canopy 13 and the second canopy 20. Meanwhile, the residual water drops remained on the second canopy 20 will drip into the receiving space derived from between the second and third canopies 20 and 50. None of the additional operation is required to timely obtain a water collection effect.

It is known that the second canopy 20 and the third canopy 50 have their connection spots 22 and 52 (as shown in FIG. 1) on their circumferences and connected in the spots 131 and 201 of the their underneath canopies where are covered by their circumferences. Although, there are a plurality of continuous openings a formed therearound (as shown in FIG. 5A), their bottoms are unified and communicable to the hollow interior 113 of the shank 11 (as shown in FIG. 7). So that it can receiving a maximum amount of water and the water will not be leaked or splashed out when the umbrella is oscillated or inclined.

3) When the umbrella 10 is reopened outdoor, the water received in the hollow interior 113 of the shank 11 will flow out via the passages 61 to join together with the water remained in the receiving space and splash in the rainfall (as shown in FIG. 8). Because of that the stopper means 70 stops in the upper portion 111 of the shank 11 under the passages 61, the return flow Q of the water will not leak into the lower portion 113 of the shank 11 and the handle 14.

4) If release the water manually in a house or a car (as shown in FIG. 7), to place the top of the umbrella into a container such as a bottle and remove the finishing cap 40 so that the water received in the hollow interior 113 of the shank 11 and in the receiving space including those still dripping from the surface of the first canopy 13 into the receiving space will pass through the passages 61, the hollow interior 113 and the opening 114 and pour into the container so as to achieve a complete water releasing process.

The features and advantages of the present invention are outlined as follows:

The water collection device of the present invention is derived from an umbrella and collects the residual water drops when the umbrella is closing. However, the water collection device is invisible when the umbrella is opening.

1. On the structure:

a) it timely collects the residual water dripped from the surface of an umbrella in order to prevent the floor of a house or a car from wetted.

b) it bears no any burden to the umbrella to facilitate a readily opening of the umbrella.

c) it prevents the umbrella from adding a lot of complicated components and maintains the original appearance for an umbrella.

2. On industrialization a) the present invention adds only a small piece of cloth and plastic stopper means which increases no cost to manufacture. In manufacturing, the second and third canopies can be processed together with the first canopy in one step thus increasing only a small amount of time and labor.

b) almost any umbrella factory can manufacture this umbrella immediately without adding any additional equipments or machinary. This proves substantially the industrial utility of the present invention.

Although this invention has been described with a certain degree of particularity, it is understood that the present invention disclosure has been made by way of example only and that numerous changes in the detailed construction and the combination and arrangement of parts may be resorted to without departing from spirit and scope of the invention as hereinafter claimed.

What is claimed is:

1. A water collection device in combination with an umbrella comprising:

an umbrella having a tubular shank and a plurality of ribs pivotably secured to a top portion of said shank, a first canopy having a diameter and being mounted on said ribs and attached to said shank by a finishing cap and a ferrule on top end of said shank, a handle secured to a lower portion of said shank;

a second canopy having a diameter of ⅙ of said diameter of said first canopy; said second canopy having a central bore co-axially wrapped and closed on the top of said shank between said ferrule and said first canopy; said second canopy being circumferentially attached to said first canopy at equal intervals by a plurality of first connection spots; each of said first connection spots is positioned at the middle of a latitudinal line on each canopy section of said first canopy located between each pair of adjacent ribs;

wherein a plurality of continuous openings, formed between each pair of adjacent first connection spots, are unified with a water receiving space which extends between said first and second canopies when said umbrella is closed.

2. A water collection device in combination with an umbrella according to claim 1 further comprises:

a third smaller canopy having a diameter of ⅙ of the diameter of said second canopy; said third canopy having a second central bore co-axially wrapped and closed on top of said shank between said ferrule and said second canopy; said third canopy being circumferentially attached to said second canopy at equal intervals by a plurality of second connection spots;

said second connection spots being positioned at the middle of a latitudinal line of each cover section of said second canopy between adjacent first connection means;

whereby a plurality of second continuous openings, formed between each pair of adjacent second connecting spots, are unified with a second water receiving space which extends between said second and third canopies when the umbrella is closed.

3. A water collection device in combination with an umbrella according to claim 1 further comprises:

a water conduit and releasing system in an upper portion of said shank having a plurality of passages formed around the peripheral wall of said shank; said passages being communicating with said first and second water receiving spaces, a stopping means secured to the upper portion of said shank under said passages, and said finishing cap removably closed the top of said shank.

* * * * *